US005501162A

United States Patent [19]

Kravets

[11] Patent Number: 5,501,162

[45] Date of Patent: Mar. 26, 1996

[54] METHOD OF FUEL COMBUSTION

[76] Inventor: Alexander Kravets, #613 B Cranbury Cross Rd., North Brunswick, N.J. 08902

[21] Appl. No.: 92,818

[22] Filed: Jul. 19, 1993

[51] Int. Cl.[6] ..... F23D 1/00

[52] U.S. Cl. ..... 110/347; 110/204

[58] Field of Search ..... 431/2, 4, 11, 115, 431/116; 110/342, 347, 204

[56] References Cited

U.S. PATENT DOCUMENTS 3,682,114 8/1972 Scheubel ..... 110/347

4,211,174 7/1980 Martin et al. ..... 110/347 X 4,741,279 5/1988 Azuhata et al. ..... 110/347

5,154,599 10/1992 Wunning ..... 110/204 X

*Primary Examiner*—Denise L. Gromada

[57] ABSTRACT

A combustion is performed with a fuel which has been reformed by mixing with combustion products and/or water steam to supress $NO_x$ formation.

5 Claims, 3 Drawing Sheets

METHOD OF FUEL COMBUSTION

BACKGROUND OF THE INVENTION

The present invention relates to methods of combustion of hydrocarbon fuels, such as gaseous, liquid and solid fuels.

Fuel combustion is widely utilized for industrial and residential purposes. Existing methods of fuel combustion cause environmental problems, such as atmospheric global warming or "greehouse effect", and pollution with some hazardous oxides produced during combustion. In addition, since both air and fuel contain nitrogen, they are both sources of nitrogen oxides formation. In particular, air and fuel involved in the combustion process will unavoidably form strong pollutants such nitric oxide NO and Nitrogen dioxide $NO_2$ which are customarily denoted together as $NO_x$.

SUMMARY OF THE INVENTION

Accordingly, it is an object of the present invention to provide a method of fuel combustion, which avoids the disadvantages of the prior art.

More particularly, it is an object of the present invention to provide a method of fuel combustion, in which nitrogen oxides are suppressed.

In keeping with this objects and with others which will become apparent hereinafter, one feature of the present invention resides, briefly states, in a method of fuel combustion, in accordance with which combustion is performed with a fuel which has been reformed (converted) by mixing of fuel with a substance selected from the group consisting of combustion products containing $CO_2$, $H_2O$, $N_2$, water steam and both, at high temperatures.

When the combustion is performed in accordance with the present invention, nitrogen oxides are substantially suppressed. Since the fuel is mixed with the combustion products and/or water steam in the initial stage of combustion (burning), this prevents formation of prompt $NO_x$. This however leads to formation of $NH_3$ and its radicals which in turn react with the nitrogen oxides forming in the primary and secondary stages of combustion. In the inventive method there is a transition to CO and $H_2$, and therefore even at low level of "reforming" (conversion of fuel with the combustion products and/or water steam) as low as 65%, at least equivalent $NO_x$ suppression is obtained against the conventional approved low $NO_x$ control combustion methods, as has been proven by tests conducted with the method of the present invention. The excessive formation of $NH_3$ with the presence of $H_2$ creates conditions for in-flame decrease of $NO_x$ formation, which is similar to the effect of post-combustion purification, such as the selective non-catalytic reactions.

The novel features of the present invention are set forth in particular in the appended claims. The invention itself, however, both as to its construction and method, will be best understood from the following description of preferred embodiments which is accompanied by the following drawings to illustrate the preferred embodiments of the invention.

DESCRIPTION OF PREFERRED EMBODIMENTS

Figure 1:
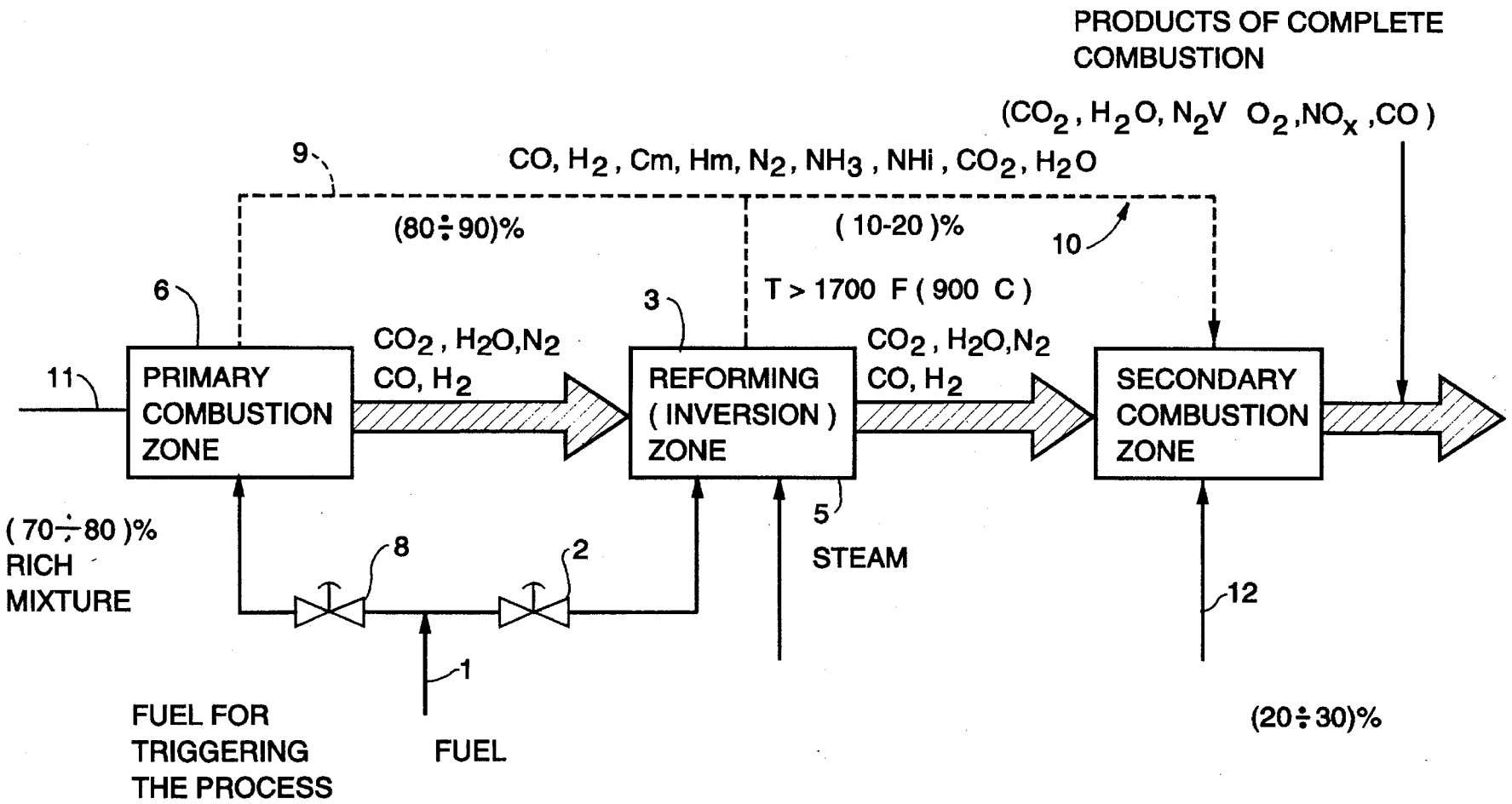
FIG. 1 is a view schematically shown a method of combustion fuels in accordance with the present invention.

In accordance with the present invention as illustrated in FIG. 1, conversion of a gaseous and/or liquid hydrocarbon fuel is performed in a mixture with combustion products and/or water steam.

As shown in the drawings, fuel 1 (for example, natural gas, oil, coal, or others) is supplied through a valve 2 into a so-called reforming zone 3. A reforming agent, such as combustion products 4, is also supplied to the reforming zone 3, In accordance with another modification of the invention, a reforming agent, such as water steam 5 is supplied to the reforming zone. In accordance with still another modification of the invention, both the combustion products 4 and the water steam 5 are supplied to the reforming zone 3. The combustion products can contain $CO_2$, $H_2O$, $N_2$, CO, $H_2$. The preferable ratios are: Combustion products/fuel=6:1; Water steam/fuel=1.3:1. when they are used separately.

In the reforming zone 3, the reforming or conversion of fuel is performed at temperatures which are not below 1700° F. (approximately 900° C.), in order to obtain substantial effect, or in other words high degree of conversion of the initial fuel into carbon oxide and hydrogen. The time of dwelling of the fuel in the reaction zone of the reforming must be approximately 0.015 sec. The reforming effect increases with the increase of the temperature in the reforming zone and can reach 75–85%, without the use of costly catalists.

Since the fuel is mixed with the combustion products and/or steam on an initial stage of combustion, the formation of prompt $NO_x$ is excluded. $NH_3$ and its radicals which are formed, interact with nitrogen oxides formed during the primary and secondary combustions. The reformed fuel contains substantial concentration of CO and $H_2$. Their combustion is performed with substantially higher speeds than of the initial fuel. This, in turn, causes a substantial shortage of oxygen, for much more slower reactions of $NO_x$ formation Therefore, the amount of formed $NO_x$ is substantially reduced, 8–10 times. In addition the heat of combustion of the reformed fuel is increased by 5–10% with the reforming degree of 75%, and the process heat efficiency is increased by 4–6% with reference to the high heat value of the initial fuel.

As can be seen from FIG, 1, the reformed fuel is supplied to the primary combustion zone 6 (80–90%) and to the secondary combustion zone (10–20%) 7. These zones are supplied with air (70–80% for the primary combustion zone and 20–30% for the secondary combustion zone), and combustion of the reformed fuel is performed in these zones. The primary combustion zone is ignited by the same initial fuel 1 through the valve 8, and then the valve 8 is shut off after the required temperature is reached in the reforming zone 3. The reformed fuel supplied from the reforming zone 3 to the primary combustion zone and the secondary combustion zone are identified as 9 and 10, while the primary and secondary air supplied to these zones are identified as 11 and 12.

Figure 2:
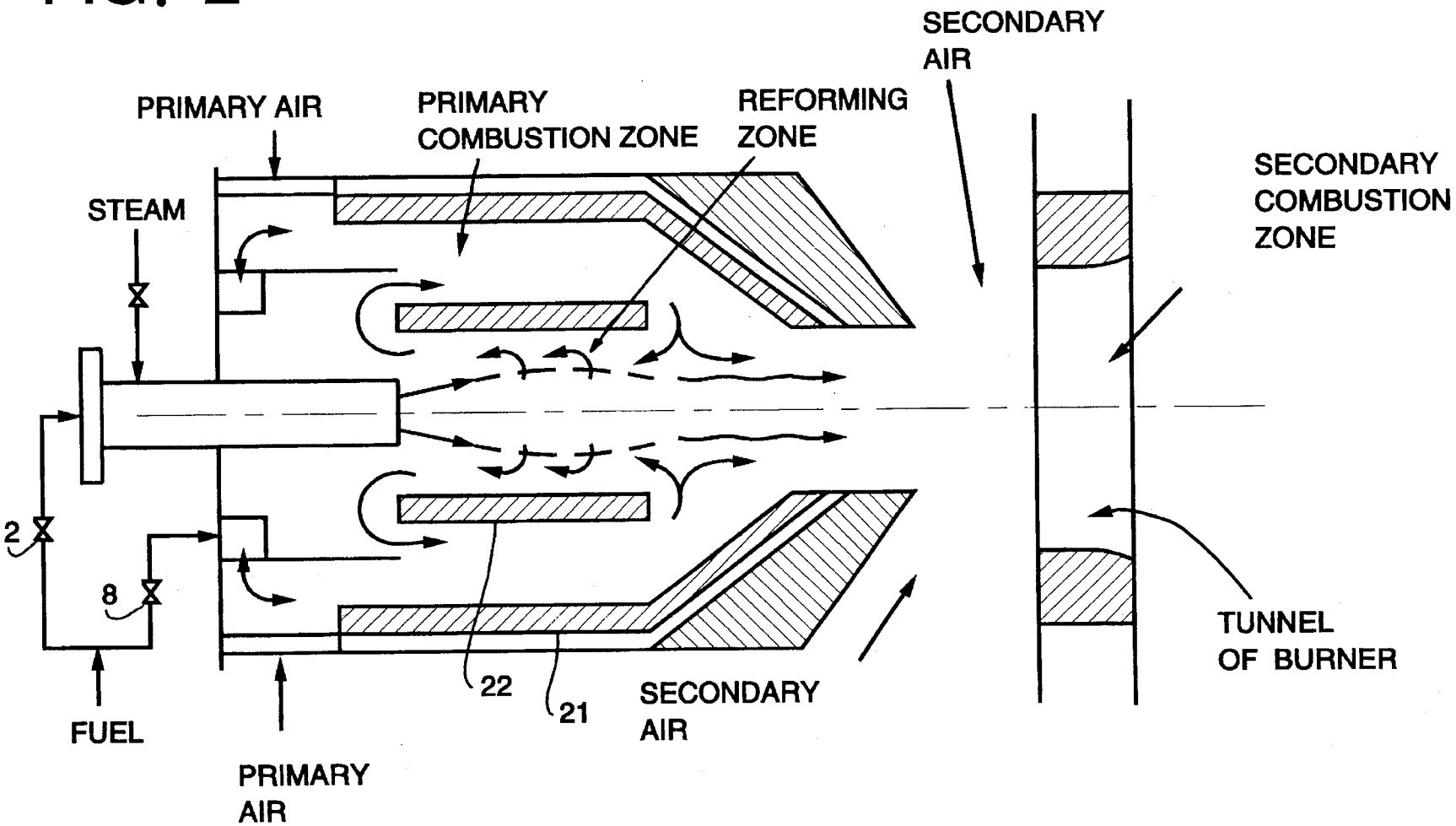
FIG. 2 is a view showing a so-called open arrangement for performing the method of combustion fuels in accordance with the present invention.

An arrangement of an open type for performing the inventive method is shown in FIG. 2. It has an outer casing 21, an inner circulating insert 22, corresponding conduits, etc. Reference numerals in this drawing which correspond to the reference numerals of FIG. 1 are utilized. The triggerring of the process is performed in the same manner. When the valve 8 is opened, the fuel is mixed with the primary air. When the temperature 1700°–2000° F. is reached in the reforming zone, the valve 8 is gradually closing and the valve 2 is gradually opening. When the valve 8 is closed, all fuel is supplied through the central nozzle with a low outlet pulse of fuel. Due to the constriction in the outlet opening of the combustion zone 6 and injection effect created by the primary air, approximately 0% of combustion products recirculate in the primary combustion zone. These combustion products participate in the reforming reaction. The fuel (its main stream) passes over U-shaped paths and dye to the ratio of pulses of the initial fuel and the recirculation is returned to the primary combustion zone. A part of the reformed fuel (10–20%) is supplied to the secondary combustion zone. When necessary, in order to increase the reforming degree, steam is supplied through the nozzle into the reforming zone. The heat for the reforming is obtained both from the products of recirculation, and also by heat condition through the separating wall.

Figure 3:
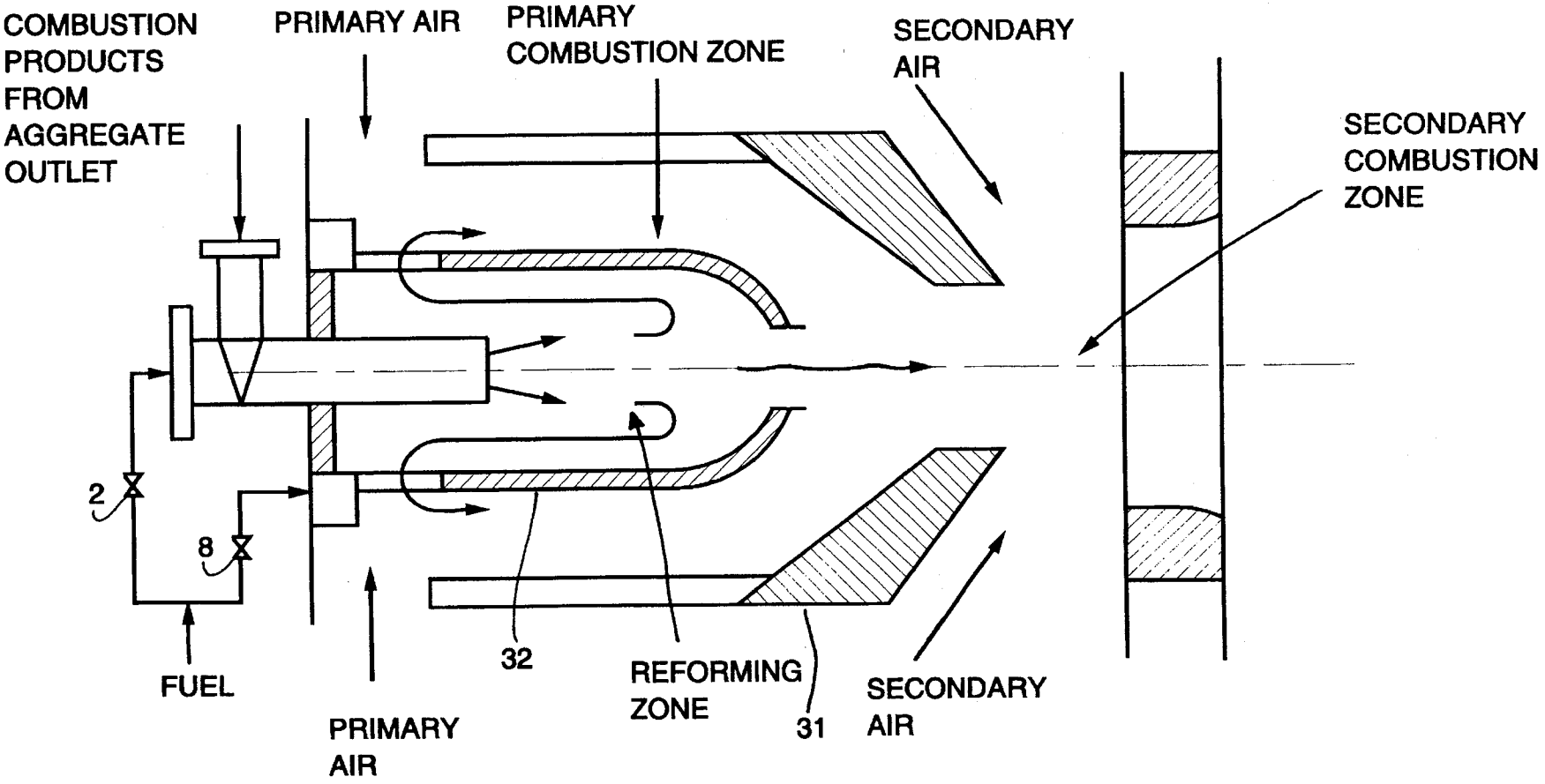
FIG. 3 is a view showing a so-called closed arrangement for performing the method of combustion fuels in accordance with the present invention.

An arrangement in accordance with a closed type is shown in FIG. 3 and has an outer casing 31, an inner insert 32 and corresponding conduits, etc. Reference munerals from FIG. 1 are utilized here as well. This arrangement is different in that, the combustion products are taken from an outlet of an aggregate, for example from a burner or economizer of a boiler. The heat necessary for reforming is provided to a substantial degree (90–95%) due to the heat transfer through the separating wall. The central opening in the end side determined a part of the reformed fuel which is supplied into the secondary combustion zone.

The present invention is not limited to the details shown since various modifications and structural changes are possible without departing in any way from the spirit of the present invention.

What is desired to be protected by Letters Patent is set forth in particular in the appended claims.

I claim:

1. A method of fuel combustion, comprising the steps of subjecting a hydrocarbon fuel to a reforming by mixing the fuel with a substance selected from the group consisting of combustion products, water steam and a mixture of combustion products and water steam at high temperature; and supplying the thusly reformed fuel to at least one combustion zone which in a combustion of the reformed fuel with air is performed, said subjecting including using the temperature of at least 1,700° F.

2. A method of fuel combustion, comprising the steps of subjecting a hydrocarbon fuel to a reforming by mixing the fuel with a substance selected from the group consisting of combustion products, water steam and a mixture of combustion products and water steam at high temperature; and supplying the thusly reformed fuel to at least one combustion zone which in a combustion of the reformed fuel with air is performed, said combustion products being combustion products produced from said combustion zone.

3. A method of fuel combustion, comprising the steps of subjecting a hydrocarbon fuel to a reforming by mixing the fuel with a substance selected from the group consisting of combustion products, water steam and a mixture of combustion products and water steam at high temperature;

supplying the thusly reformed fuel to at least one combustion zone which in a combustion of the reformed fuel with air is performed; and supplying the thusly reformed fuel also to another combustion zone in which a combustion of the reformed fuel with air is performed, said first mentioned combustion zone and said another combustion zone being primary and secondary combustion zones, said combustion products are combustion products produced from the secondary combustion zone.

4. A method of fuel combustion, comprising the steps of subjecting a hydrocarbon fuel to a reforming by mixing the fuel with a substance selected from the group consisting of combustion products, water steam and a mixture of combustion products and water steam at high temperature;

supplying the thusly reformed fuel to at least one combustion zone which in a combustion of the reformed fuel with air is performed; and supplying the thusly reformed fuel also to another combustion zone in which a combustion of the reformed fuel with air is performed, said combustion zones being a primary combustion zone to which 80–90% of the reformed fuel is supplied and a secondary combustion zone to which 10–20% of the reformed fuel is supplied.

5. A method of fuel combustion, comprising the steps of subjecting a hydrocarbon fuel to a reforming by mixing the fuel with a substance selected from the group consisting of combustion products, water steam and a mixture of combustion products and water steam at high temperature;

supplying the thusly reformed fuel to at least one combustion zone which in a combustion of the reformed fuel with air is performed; and supplying the thusly reformed fuel also to another combustion zone in which a combustion of the reformed fuel with air is performed, said combustion zones being a primary combustion zone and a secondary combustion zone, said combustion products being combustion products from the secondary combustion zone.

* * * * *